United States Patent [19]

Sigler

[11] Patent Number: 4,759,804

[45] Date of Patent: Jul. 26, 1988

[54] MANUFACTURE OF IRON-CHROMIUM-ALUMINUM PEELING BILLET

[75] Inventor: David R. Sigler, Sterling Heights, Mich.

[73] Assignee: General Motors Corporation, Detroit, Mich.

[21] Appl. No.: 880,046

[22] Filed: Jun. 30, 1986

[51] Int. Cl.[4] ..... C21D 8/10

[52] U.S. Cl. ..... 148/2; 148/12 EA

[58] Field of Search ..... 148/2, 12 EA, 325; 420/62

[56] References Cited

U.S. PATENT DOCUMENTS

| | | | |
|---|---|---|---|
| 2,839,396 | 6/1958 | Marsh | 148/2 |
| 4,316,743 | 2/1982 | Kawai et al. | 148/12 EA |
| 4,331,631 | 5/1982 | Chapman | 422/180 |
| 4,414,023 | 11/1983 | Aggen et al. | 420/62 |

FOREIGN PATENT DOCUMENTS

| | | | |
|---|---|---|---|
| 2070644 | 9/1981 | United Kingdom | 148/325 |

OTHER PUBLICATIONS

American Society for Testing and Materials, "Standard Methods for Determining Average Grain Size", Designation E112-84 (1984).

*Primary Examiner*—Deborah Yee

*Attorney, Agent, or Firm*—Douglas D. Fekete

[57] ABSTRACT

A peeling billet of the type for producing a thin metal foil by a metal peeling process and composed of an aluminum-containing ferritic stainless steel, that is, iron-chromium-aluminum alloy, is manufactured from cast alloy. A casting is forged at an elevated temperature in a manner sufficient to work the metal by an amount equivalent to forging along an axis to produce at least a 50 percent reduction in dimension. The forged billet is annealed at a temperature at least 80 degrees greater than the forging temperature, but not greater than 1100° C., to recrystallize the metal to produce a refined grain microstructure conducive to peeling.

3 Claims, 1 Drawing Sheet

200 μm

200 μm

200 μm

MANUFACTURE OF IRON-CHROMIUM-ALUMINUM PEELING BILLET

BACKGROUND OF THE INVENTION

This invention relates to a billet of a cast aluminum-containing ferritic stainless steel having a refined grain structure particularly advantageous for producing a thin foil by a metal peeling process. More particularly, this invention relates to a method for manufacturing a peeling billet from a casting of said stainless steel, which comprises forging and annealing the casting under conditions effective to refine the grain structure to a size conducive for the peeling operation.

U.S. Pat. No. 4,331,631, issued to Chapman et al in 1982, describes the manufacture of an automotive catalytic converter comprising a metal foil carrying a ceramic coating impregnated with noble metal catalyst. The foil is formed of an aluminum-containing ferritic stainless steel comprising, by weight, about 15 to 25 percent chromium, about 3 to 6 percent aluminum and the balance mainly iron. The alloy may contain a minor constituent, such as yttrium, to improve adherence of an integrally formed oxide layer. As described in the patent, the foil is produced by a metal peeling process. A cylindrical billet of the steel is rotated about the longitudinal axis, while a cutting tool is urged against the peripheral surface to shear a continuous thin chip that forms the foil. The patent is directed to growing oxide whiskers on the foil to improve adhesion of the applied coating.

In peeling cast stainless steel, there is a tendency of the metal to tear, producing discontinuities in the foil. This is attributed to the relatively large grain size, typically exhibiting cross-sectional dimensions on the order of 10 millimeters. Billets formed from powder metal exhibit a finer grain size on the order of 90 microns that is more conducive to peeling. However, powder of the stainless steel is expensive to manufacture and requires complex processing, such as hot isostatic pressing. Thus, it is desired to form a billet from the cast metal.

Manufacturers have attempted to produce a peeling ring from a casting by a process comprising forging the casting to consolidate the metal and shape the ring. Such forging is typically carried out at an elevated temperature to facilitate metal deformation and may include a radial force applied to the peripheral surface, as well as an axial force to press the metal to a desired length. This elevated temperature forging is inherently accompanied by recrystallization. However, heretofore this recrystallization has resulted in only limited grain refinement, producing a grain size on the order of 1 millimeter, significantly greater than the optimum size for peeling.

Therefore, it is an object of this invention to provide a fine-grain billet of the type used in a metal peeling process and derived from cast aluminum-containing ferritic stainless steel, which cast metal is forged and annealed under conditions effective to produce a refined grain structure having a size comparable to a powder metal billet and conducive to improved peelability.

SUMMARY OF THE INVENTION

In accordance with a preferred embodiment of this invention, a cylindrical peeling billet for producing a thin foil by a metal peeling operation is formed from a casting of an iron-chromium-aluminum alloy having properties, including high temperature resistance, particularly useful in a substrate for a monolith-type automotive catalytic converter. A preferred alloy comprises between about 15 and 25 weight percent chromium, between about 3 and 6 weight percent aluminum and the balance mainly iron. Optionally, the alloy may contain a minor amount up to about 1 weight percent of an additive that improves oxide adherence. A melt of the alloy is cast, producing a solid metal having a microstructure characterized by coarse grains that would tend to cause the metal to tear during peeling. The casting is forged at a temperature between about 750° C. and 900° C. by an upsetting force along an axis corresponding to the intended axis of rotation of the peeling billet. The forging is sufficient to deform the casting to reduce the axial length at least 50 percent, and preferably at least 70 percent. Forging deforms the microstructural grains, but results in limited recrystallization. Thereafter, the forged billet is annealed at a temperature at least 80° C. greater than the forging temperature, but not greater than 1100° C. Annealing is carried out for a time sufficient to uniformly heat the billet and recrystallize the metal. The product annealed billet exhibits a refined grain conducive to metal peeling operations.

Therefore, the method of this invention produces a billet of the desired iron-chromium-aluminum alloy from cast metal. The casting is forged and annealed under conditions effective to refine the grain microstructure conducive to improve peelability.

DESCRIPTION OF THE DRAWINGS

The present invention will be further illustrated with reference to the Figures wherein.

DETAILED DESCRIPTION OF THE INVENTION

A preferred embodiment of this invention was demonstrated by casting and treating a laboratory quantity of metal to produce a scaled-down peeling billet, but is applicable for casting and treating a larger quantity of metal to manufacture a billet of a size typical of production metal peeling operations. The peeling billet features a generally cylindrical shape and has a central longitudinal axis about which the billet suitably rotates during metal peeling operations. The billet was formed of a commercial alloy designated Fe-20Cr-5Al alloy. The alloy consisted of, by weight, about 18.9 percent chromium, 4.99 percent aluminum, 0.43 percent silicon, 0.23 percent manganese, 0.16 percent nickel, less than 0.05 percent copper, 0.019 percent phosphorus, 0.009 percent carbon, 0.007 percent sulfur, 0.011 percent nitrogen and the balance iron. The alloy was melted under a vacuum and cast into a slightly tapered cylindrical cold steel mold having a diameter of about 40 millimeters.

Figure 1:
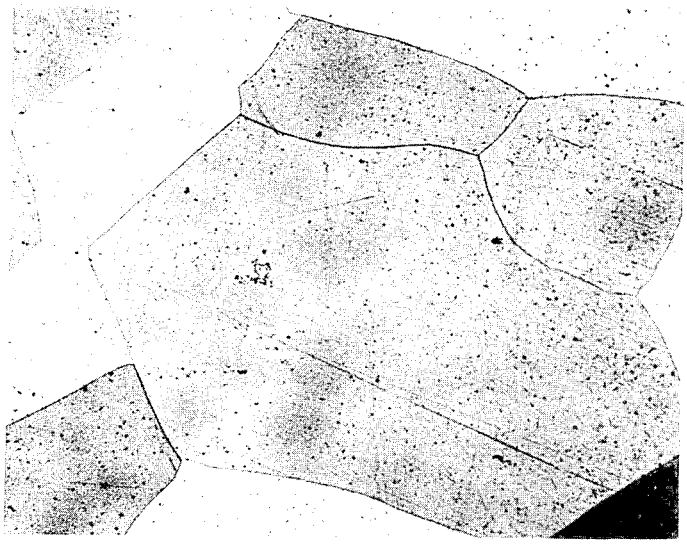
FIG. 1 is a photomicrograph of a casting of a preferred iron-chromium-aluminum alloy and showing the as-cast microstructure.

FIG. 1 is a photomicrograph of a cross section of the cylindrical casting taken parallel to the longitudinal axis and showing the as-cast grain structure. The alloy surface was etched using a conventional glycerol solution containing nitric acid, hydrochloric acid and acetic acid. As indicated by the accompanying scale, the microstructure comprises coarse grains having cross-sectional dimensions on the order of a tenth of a millimeter. For comparison to this laboratory-size casting, experience has indicated that larger production-size billets exhibit an even larger grain size, which is attributed to a slower cooling rate. It has been found that the coarse grain metal shown in FIG. 1, or the even coarser grain metal in production castings, are difficult to peel to produce a continuous thin foil. While not limited to a particular theory, it is believed that metal peeling produces plastic deformation at grain boundaries. A coarser grain has a reduced boundary area, concentrating plastic deformation forces and resulting in tearing.

The casting was sectioned perpendicular to the axis to obtain a 25 millimeter long cylindrical slug suitable for forging. The slug was heated at a temperature of about 870° C. and forged by applying an axial force to upset the metal using a conventional hammer forge. The forged billet had an axial length of about 12.5 millimeters, representing a reduction of about 50 percent.

Figure 2:
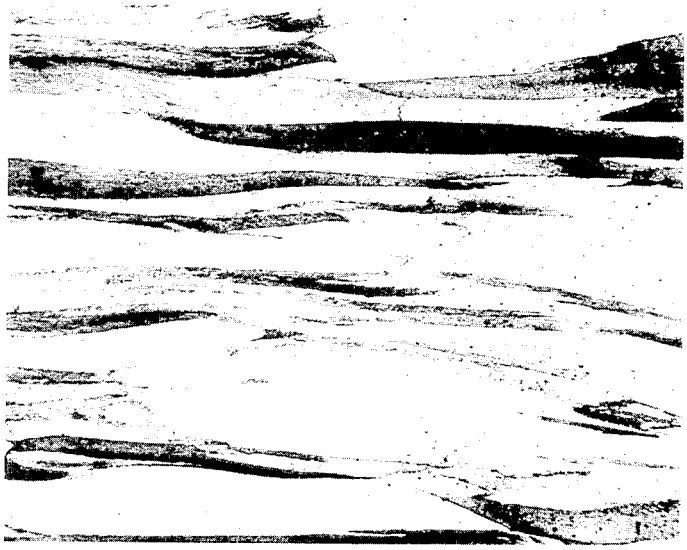
FIG. 2 is a photomicrograph of a forging derived from the casting in FIG. 1 in accordance with this invention and showing the microstructure.

FIG. 2 is a photomicrograph of the microstructure of the forged metal viewing a cross sectional plane parallel to the forging axis and prepared similarly to FIG. 1. As seen in FIG. 2, the upsetting force of the forging operation pancakes the grains. Despite some recrystallization during the elevated temperature forging, experience has indicated that grains of the size shown in FIG. 2 result in the metal having a tendency to tear during peeling.

Figure 3:
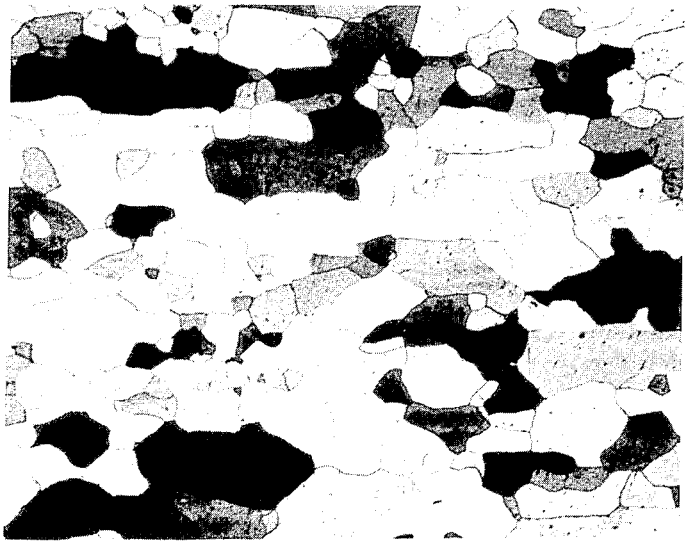
FIG. 3 is a photomicrograph of an annealed billet derived from the forging in FIG. 2 in accordance with this invention and showing the refined microstructure.

Following the forging operation, the slug was annealed at about 980° C. for approximately 15 minutes. The microstructure of the product billet is shown in FIG. 3. The field of view was located along a cross section near the billet axis and prepared by etching in a manner similar to FIG. 1. As can be seen, annealing resulted in recrystallization and produced a microstructure having a significantly finer grain size.

The average grain size for the sample in FIG. 3 was determined using ASTM Standard Method E112-84, incorporated herein by reference. In accordance with the three-circle intercept procedure set forth in ASTM E112, a pattern comprising three concentric circles is overlaid onto a magnified field of the specimen and intersections of circles with grains boundaries are counted. The number of intersections indicates the ASTM grain size number. Following this procedure, the ASTM size number for the sample shown in FIG. 3 was determined to be 3.2. The procedure of ASTM E112 is not suitable for determining a grain size number for grains as large as those of the as-cast microstructure in FIG. 1 or for pancaked grains of the type shown in FIG. 2.

Thus, in the described embodiment, a single cycle comprising forging and annealing steps was employed to produce a steel having an ASTM grain size of 3.2. In general, a larger ASTM size number indicates a finer grain structure. It is believed that metal having a grain size of ASTM 3 is suitable for metal peeling to produce a foil, although a grain size greater than 4 is preferred. ASTM size number 3.2 corresponds roughly to a mean intercept distance of 115 microns. If necessary, the metal may be further treated by forging and annealing steps carried out under conditions in accordance with this invention to further refine the grain structure.

The grain refinement treatment of this invention is applicable to iron-base alloys comprising 3 to 6 weight percent aluminum and 15 to 25 weight percent chromium. Minor additions of other metals, such as rare earth metals, yttrium, zirconium, hafnium, titanium and calcium, may optionally be made to enhance desired properties of the steel. In particular, yttrium in an amount up to about 1 percent is advantageous to enhance adhesion of an oxide scale formed on a product foil to protect underlying metal against corrosion. Alternately, cerium and lanthanum, preferably added in mischmetal in an amount up to about 0.1 percent, similarly improves adhesion of an integrally formed oxide. Zirconium, hafnium and titanium are added to improve mechanical properties and may affect grain characteristics of the alloy.

In accordance with this invention, the cast steel is forged at an elevated temperature sufficient to facilitate metal deformation, preferably 750° C. or greater. However, forging temperature is not so great as to result in rapid, spontaneous recrystallization which, if allowed to occur, results in excessive grain growth. Temperatures above about 900° C. tend to produce spontaneous grain growth and are thus not desired. In the described embodiment, forging was carried out by applying an upsetting force along the longitudinal axis. The cast steel may also be suitably worked by a radial forging operation, such as a high speed radial forging operation or a double octagon radial forging operation, or by a combination of radial and axial forging operations. In the described embodiment, the steel is forged to reduce the axial dimension by about 50 percent. The pancaking effect produced by axial forging deforms metal more severely in the midsection than at the ends. In view of the laboratory scale of the samples in the described embodiment, it is believed that the midsection, from which samples for FIGS. 2 and 3 were taken, is deformed at least 70 percent. Thus, for production scale casting, although it is believed that a 50 percent reduction in axial dimension is suitable for grain refinement in accordance with this invention, a 70 percent reduction is preferred.

In accordance with this invention, forging is followed by a recrystallization anneal carried out at a temperature greater than a forging temperature. It is desired that the anneal temperature be at least 80° C. greater than the forging temperature. However, annealing temperatures greater than about 1100° C. create rapid grain growth and are thus not desired to produce fine grain. Annealing is preferably continued for a time sufficient to uniformly heat and recrystallize the billet, but is preferably not prolonged so that grain growth is minimized, particularly at more elevated temperatures within the preferred range.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A method for manufacturing a generally cylindrical aluminum-containing ferritic stainless steel billet having a refined grain structure, said method comprising providing a generally cylindrical cast metal billet of a metal comprising between about 15 and 25 weight percent chromium, between about 3 and 6 weight percent aluminum, and the balance predominantly iron, said billet having a longitudinal axis and being characterized by a substantially as-cast microstructure, forging the billet at an elevated temperature suitable for plastic deformation while avoiding spontaneous recrystallization, said forging working the metal by an amount equivalent to reducing the axial dimension by at least 50 percent, and annealing the forged billet at a temperature at least 80° C. greater than the forging temperature but not greater than 1100° C. to recrystallize the metal to produce a fine grain microstructure.

2. A method for manufacturing a generally cylindrical aluminum-containing ferritic stainless steel billet having a refined grain structure conducive for peeling to produce a foil, said method comprising providing a generally cylindrical cast metal billet of a metal comprising between about 15 and 25 weight percent chromium, between about 3 and 6 weight percent aluminum, optionally a suitable oxide-adherence agent in an amount effective to promote adherence of an oxide layer integrally formed on the metal, and the balance substantially iron, said cast metal billet having a longitudinal axis and being characterized by a substantially as-cast microstructure, forging the billet at a temperature between about 750° C. and 900° C., said forging working the metal by an amount equivalent to reducing the axial dimension by at least 50 percent and producing a generally cylindrical forged billet having a microstructure characterized by severely deformed grains, and annealing the forged billet at a temperature at least 80° C. greater than the forging temperature but not greater than 1100° C. for a time sufficient to recrystallize the metal to produce a fine grain microstructure.

3. A method for manufacturing an aluminum-containing ferritic stainless steel peeling billet of the type employed to produce a thin foil by a metal peeling operation, wherein the billet is rotated about a central longitudinal axis, said method comprising casting an alloy comprising between about 15 and 25 weight percent chromium, between about 3 and 6 weight percent aluminum, optionally a constituent selected from the group consisting of yttrium and cerium in an amount effective to promote adherence of an oxide layer integrally formed on the metal, and the balance substantially iron, forging the casting to produce a generally cylindrical billet, said forging being carried out at a temperature of at least about 750° C. to promote plastic deformation but not greater than about 900° C. to avoid spontaneous recrystallization, said forging being effectuated by a force applied along an axis corresponding to the intended billet longitudinal axis and effective to produce at least a 70 percent reduction in the axial dimension, and annealing the forged billet at a temperature at least 80° C. greater than the forging temperature but not greater than 1100° C. to recrystallize the metal to produce a fine grain microstructure characterized by grain size determined by ASTM E112 of greater than 3, said fine grain size significantly improving metal peelability.

* * * * *